US005842742A

United States Patent [19]

Hoshino

[11] Patent Number: 5,842,742

[45] Date of Patent: Dec. 1, 1998

[54] MECHANISM FOR PREVENTING THE SHAKING OF A DRUM CHAIR

[75] Inventor: Yoshihiro Hoshino, Nagoya, Japan

[73] Assignee: Hoshino Gakki Kabushiki Kaisha, Japan

[21] Appl. No.: 779,169

[22] Filed: Jan. 6, 1997

[30] Foreign Application Priority Data

May 28, 1996 [JP] Japan ..... 8-157670

[51] Int. Cl.[6] ..... A47C 3/40

[52] U.S. Cl. ..... 297/338; 248/405; 248/188.4; 297/344.18; 297/461

[58] Field of Search ..... 297/344.12, 344.18, 297/338, 461; 248/161, 405, 188.4, 188.5; 403/109, 365; 384/32, 35

[56] References Cited

U.S. PATENT DOCUMENTS

| | | | |
|---|---|---|---|
| 2,254,973 | 9/1941 | Nalle | 248/188.4 |
| 3,183,861 | 5/1965 | Halstrick | 297/334.18 X |
| 4,828,212 | 5/1989 | Dicks | 297/344.12 X |
| 4,856,929 | 8/1989 | Smahlik et al. | 248/161 X |
| 4,872,635 | 10/1989 | Knoblock et al. | 297/344.18 X |
| 5,040,758 | 8/1991 | Giovannetti | 248/188.4 |

*Primary Examiner*—Peter M. Cuomo
*Assistant Examiner*—Stephen Vu
*Attorney, Agent, or Firm*—Ostrolenk, Faber, Gerb & Soffen, LLP

[57] ABSTRACT

A chair including a mechanism for preventing shaking of the chair due to vibration of a drum performance, or the like. The chair seat is attached to an upper support post by a holder that clamps around the upper support post. The holder includes two opposite holder parts which are drawn together by tightening screws. The upper support post is received in the interior of a lower support tube. A shaking prevention compression bush is disposed on the lower part of the upper support inside the interior of the lower support and presses against the interior wall of the lower support preventing shaking of the upper and lower supports.

13 Claims, 9 Drawing Sheets

MECHANISM FOR PREVENTING THE SHAKING OF A DRUM CHAIR

BACKGROUND OF THE INVENTION

The present invention relates to a mechanism for preventing shaking of a chair, particularly a drum chair, which may occur, for example, while playing a drum.

DESCRIPTION OF PRIOR ART

FIG. 10 hereof shows an example of a known chair 60 for use when playing a drum. The chair 60 comprises a seat 61 and a lower support 70. The seat 61 includes a cushion arranged on the upper surface of the seat plate 62. The cushion is covered by a suitable surface material 63. The cushion is held by an upper support 64 located on the lower surface of the seat plate 62. The upper support is an externally profiled cylinder which is inserted into the lower support 70 and is fixed to it.

The lower support 70 has a leg section 80 comprised of a plurality of legs 81. The tops of the legs are pivoted to the lower side of the tubular installation part 73 of the lower support 70 to swing relative to that support. In addition, the lower end regions of the legs are pivotally connected to the lower end of the lower support 70 through an annular installation body 82 which is freely slidingly installed on and along lower support 70. As the installation body 82 is moved up and down along the lower support 70, the legs 81 spread pivoting radially opened or closed, with the lower support 70 as the swing center for the legs 81, making it possible for the chair legs to be spread or folded. A tightening bolt 72 fixes the annular installation body 82 along the lower support 70.

The lower support 70 includes an inner tube 71 into which the upper support 64 is inserted. An installation tubular part 73 at the top of the inner tube part 71 has an internal screw thread 74 engaged with the spiral thread 65 of the upper support. As shown in FIGS. 10 and 11, the seat 61 is rotated either to the right or to the left to adjust the length of the upper support 64 that extends from the inner tube 71 of the lower support 70 for adjusting the height of the chair. A tightening bolt 66 determines the adjusted length of the upper support 64.

In order to make it easier to store or carry the chair 60, moreover, many of such chairs enable the seat 61 to be removed from the upper support 64. As shown in FIG. 12, an installation tubular part 68, into which the top of the upper support 64 is inserted, is disposed on the reverse side or underside of and approximately at the center of the seat plate 62 for receiving the top of the upper support 64 inserted into it in a detachable manner. A screw hole 68*a* opens into the side of the installation tubular part 68. As a tightening bolt 69 is inserted and the upper support 64 is pressed through the tubular part 68, the seat plate 62 is held at the top of the upper support 64. A plane part 79 effectively adds the pressure of the tightening bolt 69.

In this prior art construction, however, either the tightening bolt 69 between the seat 61 and the upper support 64 and/or the tightening bolt 66 between the upper support and the lower support 71 may become loosened during a drum performance due to drum vibration or movement of the performer, etc. As shown in FIG. 11, the upper support 64 is located at the tip end of the installation bolt 66 and is pressed upon via a holding plate 66*a*. As a result, the tightening force of the bolt cannot be strong, and the union between the upper support and the lower support is loosened by the vibrations created during the performance.

In addition, since there is a gap between the bottom of the upper support 64 and the inner peripheral surface of the inner tubular part 71 in FIG. 11. There are cases where the upper support 64 becomes shaky around the point where the tip of the installation bolt 66 and the upper support 64 contact each other, acting as a fulcrum. Because of this it is conceivable that the seat 61 and the upper support 64 will be made integral with each other in one single body. However, this would create a problem in terms of storage and transportation of that assembly.

SUMMARY OF THE INVENTION

An object of this invention is to solve the problems described above. The invention provides a mechanism for preventing shaking or vibration of a chair, and particularly a drum chair, and for preventing loosening of the seat and upper support and loosening of the top and bottom supports in the chair, which could result from vibrations during a performance.

The invention relates to a mechanism for preventing shaking of a drum chair, wherein an upper support that holds a seat plate is fixed to a lower support that is equipped with the chair legs. The lower support includes an inner tube in which the body of the upper support is inserted. The upper support is held freely detachably, as it is held from both lateral sides by a holder. A first screw on the fixed side of the holder and a second screw on the opposite tightening side of the holder clamps the holder at its top to the upper support receiving part that is provided on the underside of the seat plate. A shaking prevention bush has a compression part that presses against the inner surface of the inner tubular part of the lower support. That bush is fixed at the lower part of the upper support.

Other objects and features of the invention are explained below with reference to the attached drawings.

DETAILED DESCRIPTION OF A PREFERRED EMBODIMENT

Figure 1:
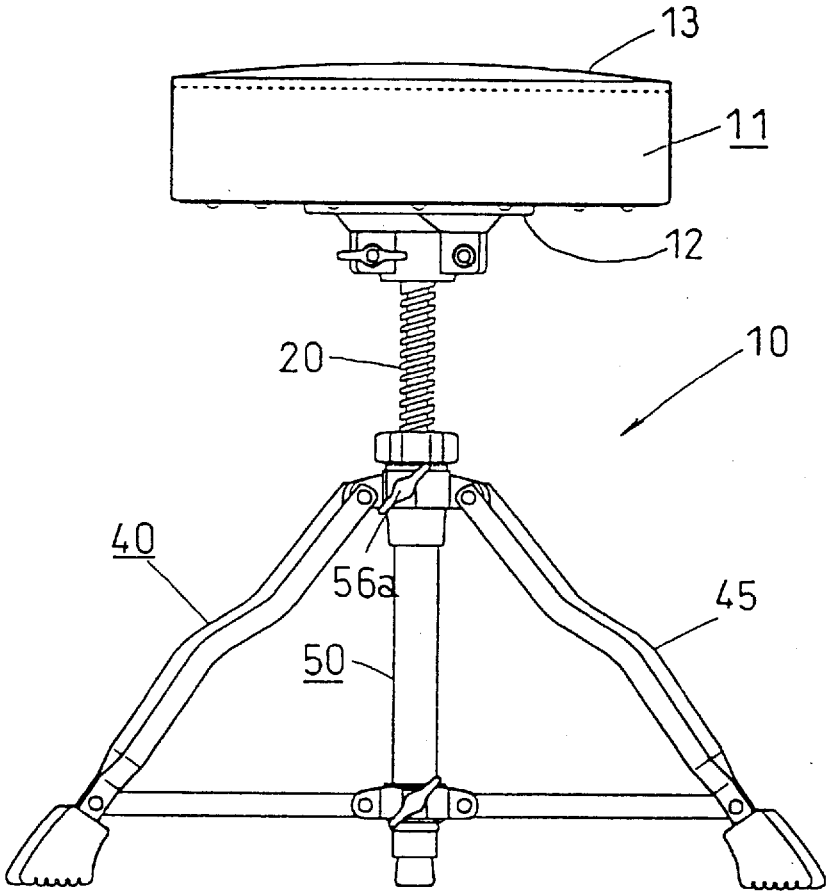
FIG. 1 is a front view of an embodiment of a drum chair having a mechanism according to the invention.

FIG. 1 shows a drum chair 10 having the mechanism according to the invention. It is comprised of a seat part 11 and a leg part 40. The seat plate 12, the upper support 20 and the lower support 50 of the leg part 40 are firmly secured, thereby making it difficult for them to be loosened by vibrations created during a performance and by the movement of the performer's body, etc.

Figure 2:
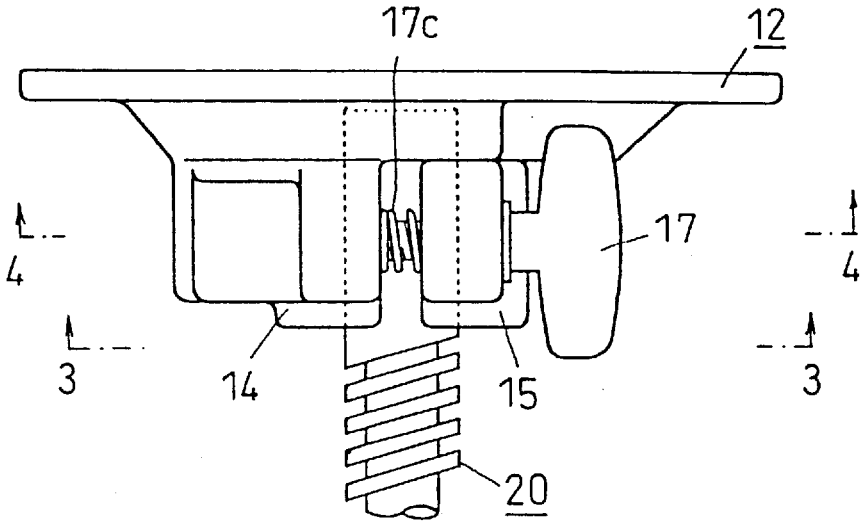
FIG. 2 is a side view of the upper support receiving part.
Figure 3:
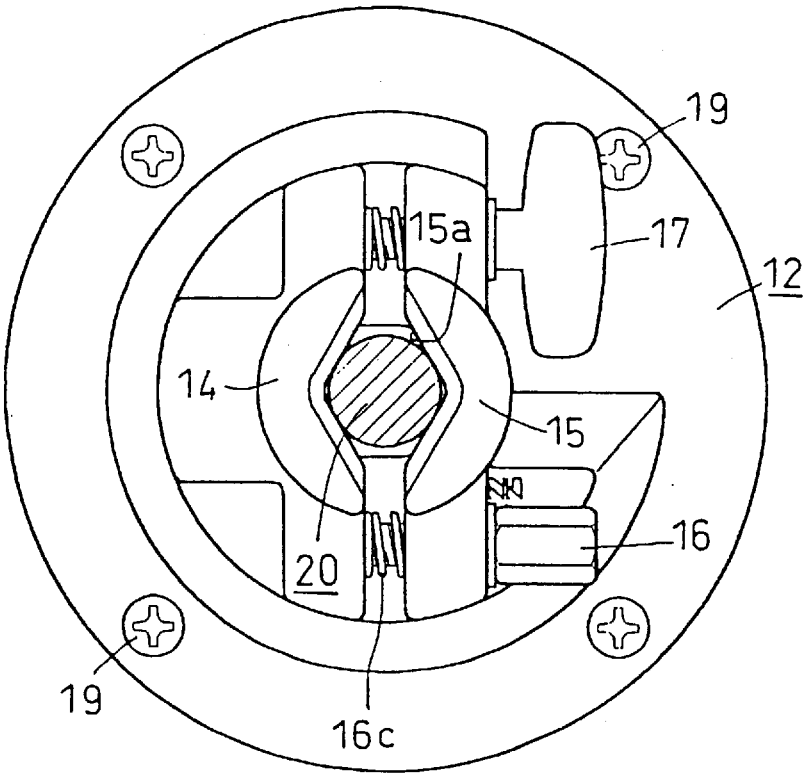
FIG. 3 is a cross section along line 3—3 in FIG. 2.

The seat 11 includes a seat surface 13 of a suitable cushion body which is disposed on the surface of the seat plate 12. The seat is held from the underside of the seat plate 12 by the upper support 20. FIGS. 2 and 3 show an upper support receiving part 14 on the underside of the seat plate 12. Installation screw 19 installs the seat plate 12 on the seat surface 13.

The upper support receiving part 14 is formed approximately in the shape of a split or half tube that cooperates with a holder 15 to clamp against opposite sides of the top of the upper support 20. As seen in FIG. 2 the part 14 is a stationary part of the underside of the seat plate 12 and is at one side of the post of the upper support 20. The part 14 has opposite end parts that extend away from opposite sides of the post 20. A holder 15 is opposite the part 14 and is movable toward and away from the part 14. Like the part 14, the holder 15 also has opposite end parts that extend away from opposite sides of the post 20. The respective end parts of the part 14 and of the holder 15 are opposite each other. A first screw 16 extends between the part 14 and the holder 15 and is located at the end parts on the fixed side and a second screw 17 extends between the part 14 and the holder 15 at the end parts located on the tightening side.

The holder 15 clamps to and supports the top part of the upper support 20 acting together with the upper support receiving part 14. The holder 15 has a concave part 15*a* on its inner side which extends along the outer surface of the upper support 20.

Figure 4:
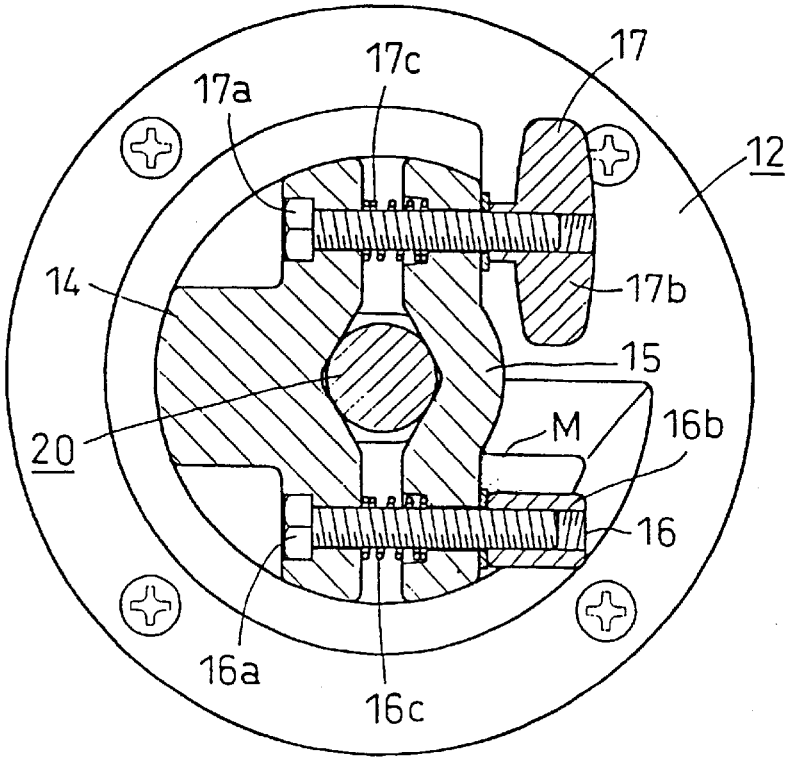
FIG. 4 is a cross section along line 4—4 in FIG. 2.

As shown in FIG. 4, the holder 15 is either tightened or loosened, as compared with the upper support receiving part 14, by the fixed side screw 16 and the tightening side screw 17.

Figure 5:
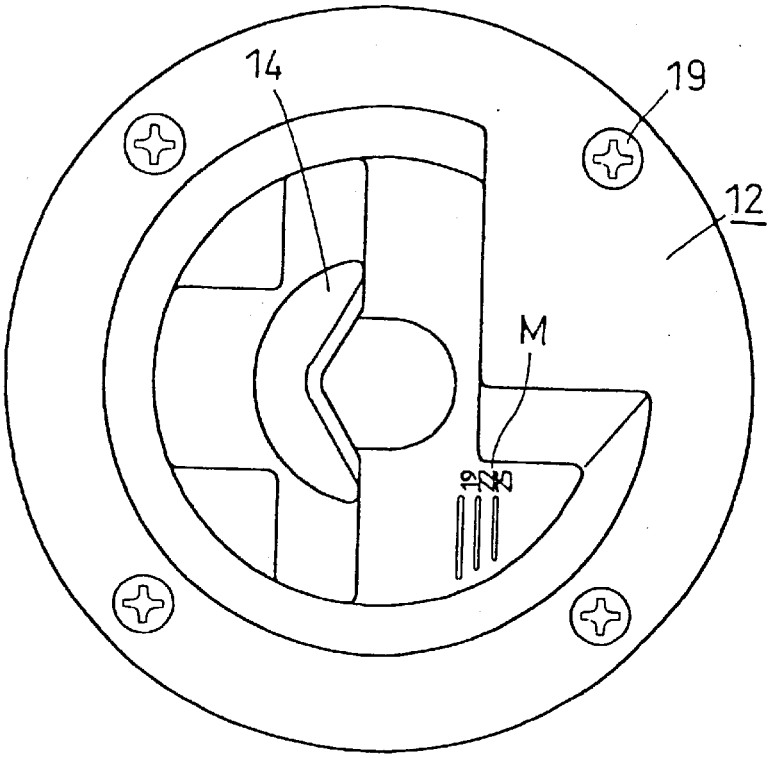
FIG. 5 is a plan view of the underside of the seat plate.

The fixed side screw 16 is comprised of a bolt 16*a* having a head end that is buried in the upper support receiving part 14. An adjusting nut 16*b* at the other end is for determining the position of the holder 15 beforehand in conformity with the diameter of the upper support 20 for installation. A spring 16C applies tension to the screw connection and blocks screw rotation. Graduations M on the reverse side of the seat plate 12, as shown in FIG. 5 show the shifted position of the holder 15 in conformity with the diameter of the top of the upper support 20. If the position of the holder 15 is determined according to the diameter of the support 20, and the fixed side screw 16 is tightened, the installation to the upper support 20 of the seat 11 becomes simple and accurate.

The tightening side screw 17 comprises a bolt 17*a* having a head at the part 14 and a nut 17*b* tightened onto the bolt. Its purpose is to tighten the upper support receiving part 14 and the holder 15 against the top of the upper support 20 that has been inserted between the parts 14 and 15 for fixing them together. A spring 17*c* maintains tension on the screw for avoiding rotation.

As shown in FIG. 3, the top part of the upper support 20 is inserted between the upper support receiving part 14 and the holder 15, which are then tightened together by the tightening side screw 17, thereby being held freely detachably.

Figure 6:
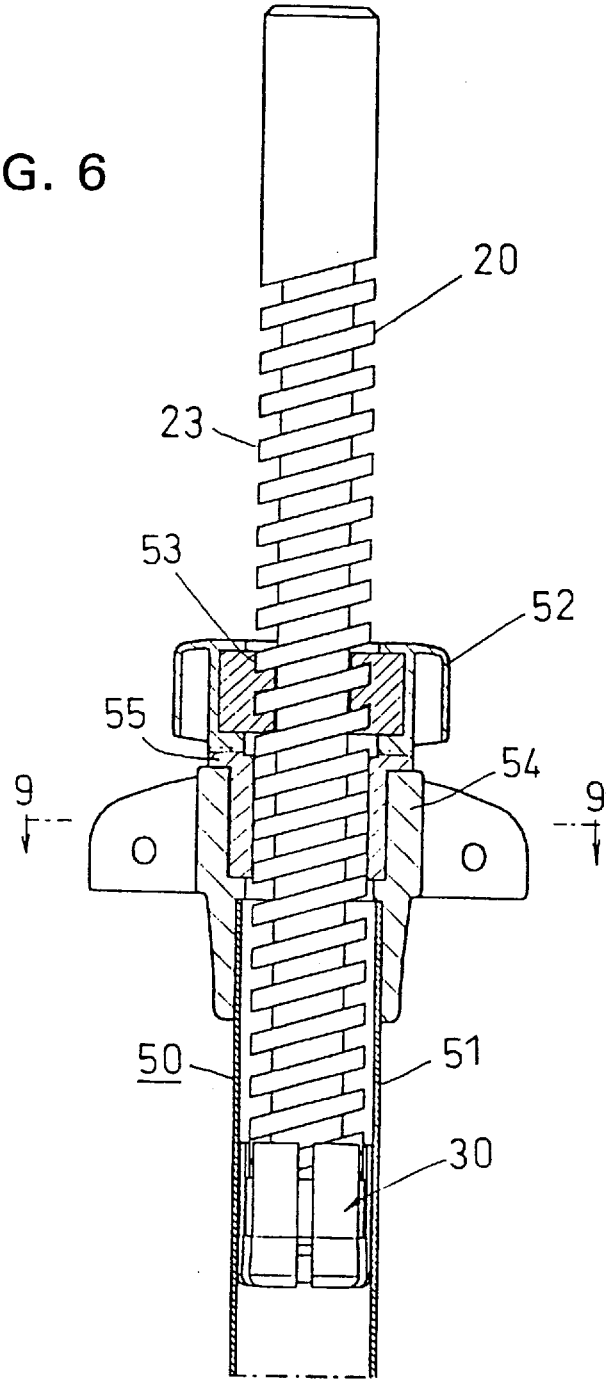
FIG. 6 is a longitudinal section through part of the chair in FIG. 1.

FIG. 6 shows a shaking prevention bush 30 fixed at the bottom of the upper support 20. It is installed in the inner tubular part 51 of the lower support 50. The purpose of the shaking prevention bush 30 is to prevent mutual shaking, even when the fixation of the upper support 20 and of the lower support 50 have been loosened.

Figure 7:
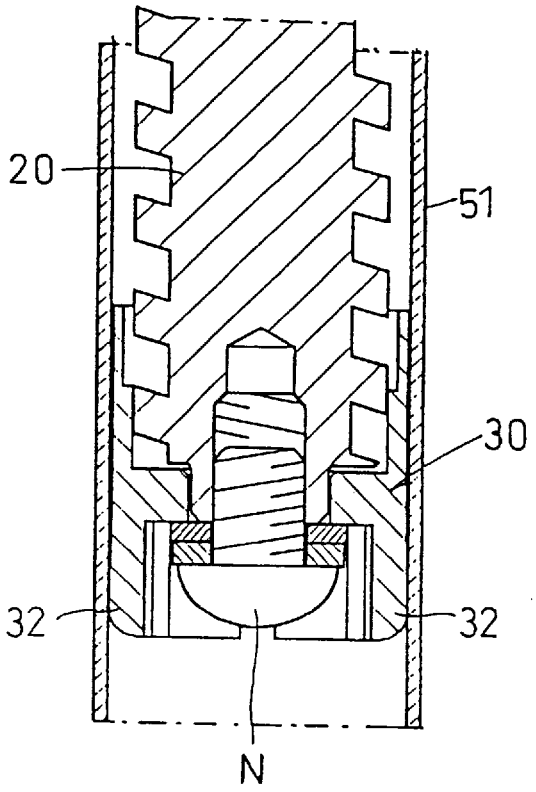
FIG. 7 is a cross section through a fragment of what is shown in FIG. 6 with its essential part expanded.
Figure 8:
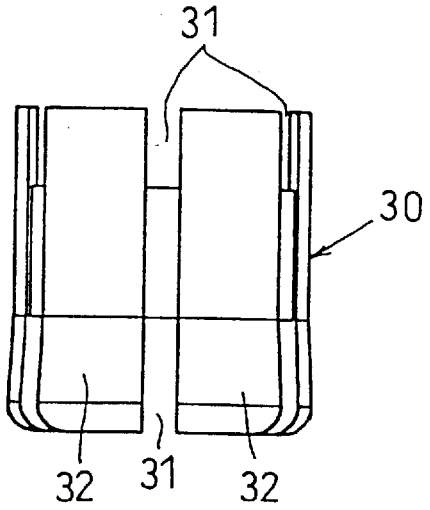
FIG. 8 is a side view of a shaking prevention bush.

An example of the shaking prevention bush is shown in FIGS. 7 and 8. This shaking prevention bush 30 is installed at the bottom of the solid upper support 20 and is fixed there by a screw N.

The shaking prevention bush 30 comprises an approximately tubular shaped body having a plurality of cut grooves 31 extending in its longitudinal direction so that the bush is divided and in axial direction strips, and the bush has a compressible part 32 pressed to the inner tube 51 near the tip of the post of the upper support. The divided nature of the bush 30 permits the shaking prevention bush 30 to be inserted, even if there is some bead on the inner diameter of the inner tubular part 51 of the lower support 50.

In addition, the compressive part 32 of the bush 30 prevents shaking of the upper support 20 as the part 32 contacts the inner peripheral surface of the tubular part 51 where this shaking prevention bush 30 has been inserted into the inner tubular part 51 together with the upper support 20. In this example, the bush 30 is formed with a tapered surface that expands outward. The expansion of the tapered surface is formed such that the bottom of the bush may become slightly larger than the inner diameter of the inner tubular part of the lower support 50. As a result, the compressive part 32 tightly adheres to the inner surface of the inner tube part 51, thereby better preventing the shaking.

The leg part 40 includes the lower support 50 equipped with a central leg part 70 and leg 45. The leg part 70 has the conventional construction.

The lower support 50 includes an inner tubular part 51 into which the upper support 20 is inserted. This fixes the upper support 20 at a desired location. As is shown in FIG. 6, a nut 52 is provided at the top of the inner tubular part 51. The inner peripheral surface of the nut 52 is screw threaded at 53 to engage with the spiral thread of the screw 23 on the outer surface of the upper support 20. As the upper support 20 is rotated to the right or to the left, the upper support 20 is moved in or out of the inner tubular part 51, while being screwed by rotation of the nut 52, so that the height of the chair or seat may be changed.

Figure 9:
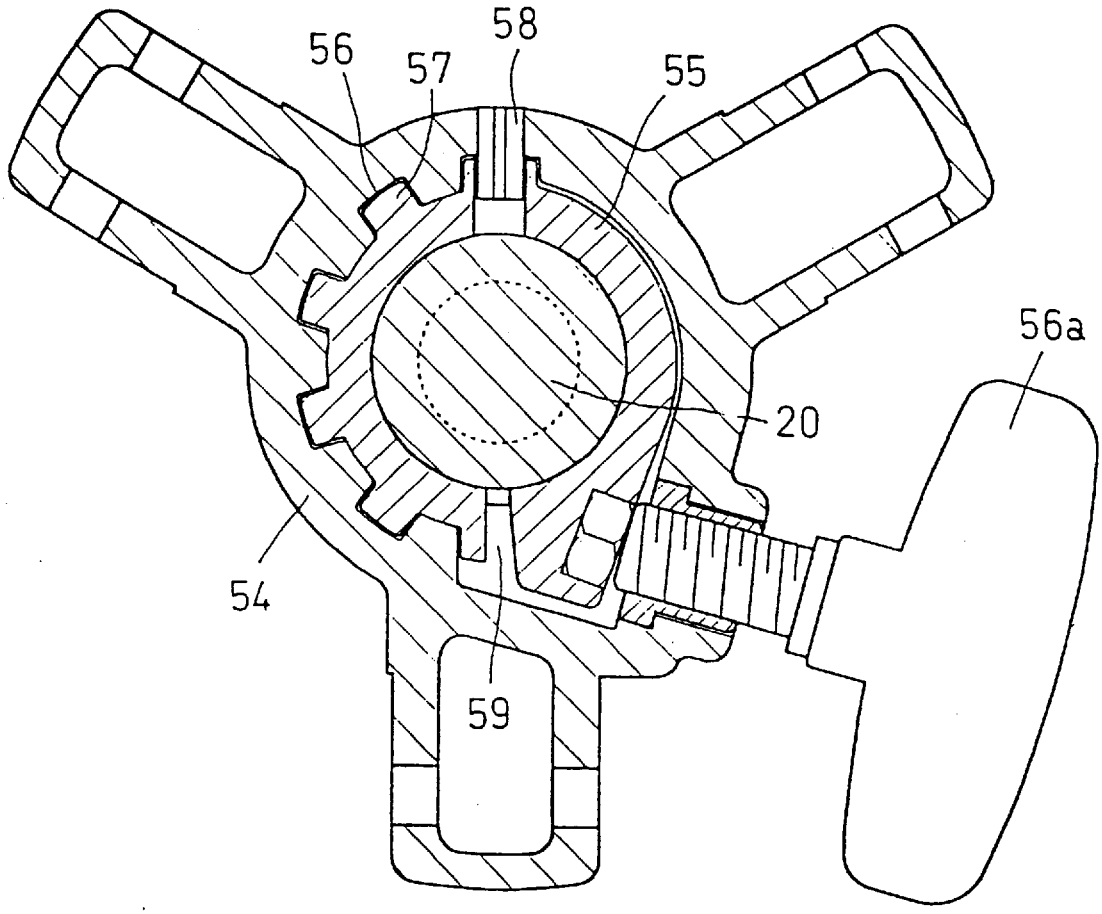
FIG. 9 is a cross section along line 9—9 in FIG. 6.
Figure 10:
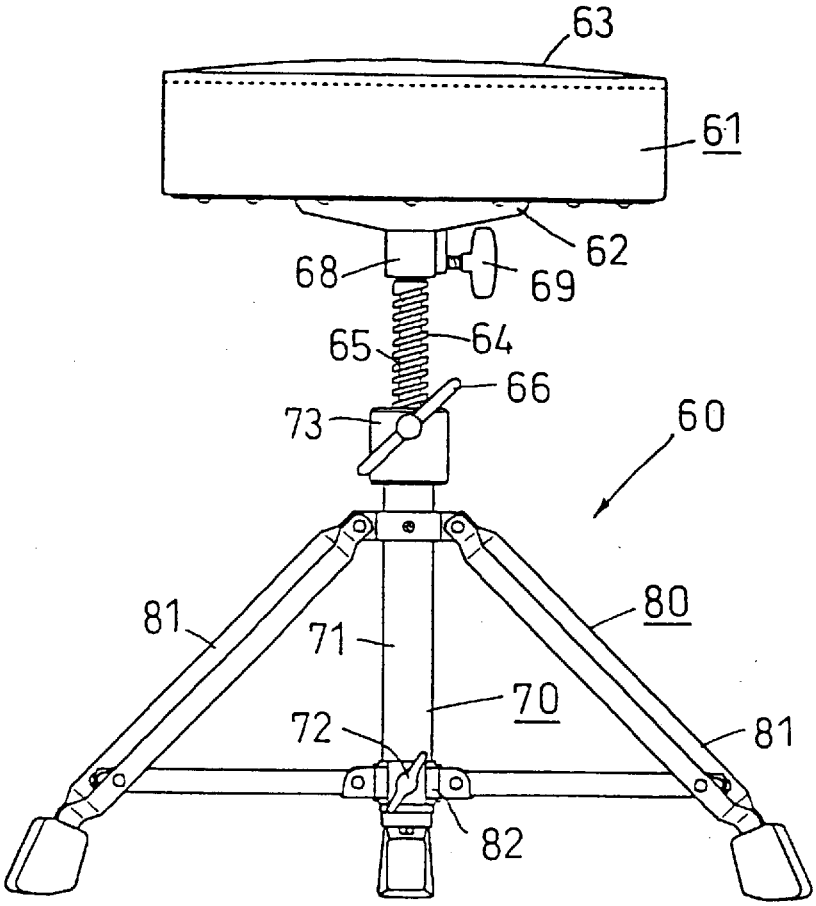
FIG. 10 PRIOR ART
FIG. 10 is a front view of an embodiment of a prior art drum chair.
Figure 11:
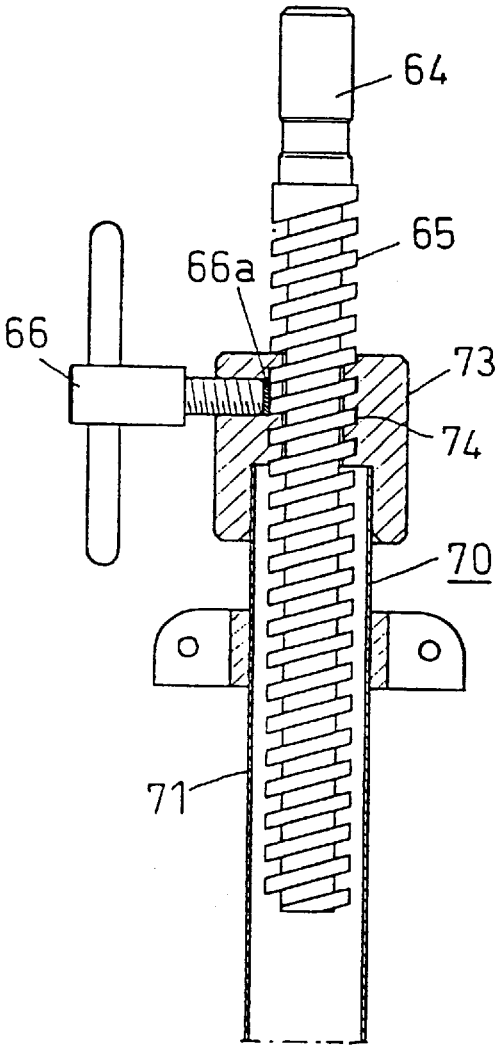
FIG. 11 PRIOR ART
FIG. 11 is a cross section of a fragment of FIG. 10 showing the structure for fixing the upper support to the lower support.
Figure 12:
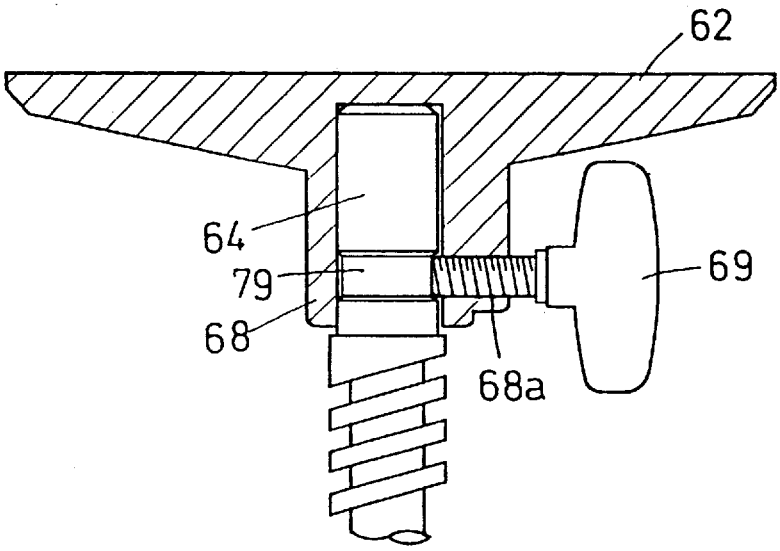
FIG. 12 PRIOR ART
FIG. 12 is a cross section showing the fixed structure of the seat and the upper support in the construction shown in FIG. 10.

The height of the chair 10 is fixed by an adjusting member 54 that is provided on the lower side of the nut 52, after height adjustment has been performed using the nut 52. As shown in FIGS. 6 and 9, the adjusting member 54 comprises a tubular body positioned around the inner tubular part 51, with a tightening member 55 accommodated in the member 54.

The tightening member 55 is a tubular body having a longitudinally splined surface 57 that fits the splined bore 56 provided on the inner peripheral surface of the adjusting member 54. The member 55 is integrally fixed by a spring pin 58 which is provided on the inner surface of the adjusting member 54.

A cut groove 59 is formed along the longitudinal direction of the inner tubular part 51 on one side of the tightening member 55. As the cut groove 59 is pressed by a tightening bolt 56*a*, the upper support 20 is fixed to the lower support 50. The material of the tightening member 55 is preferably nylon.

To adjust the height of the chair 10, the tightening bolt 56*a* is loosened, which releases the fixing of the upper support 20 to the lower support 50. The seat 11 is rotated to bring the seat surface 13 to the desired height. The tightening bolt 56*a* is tightened once again to integrally secure the upper support and the lower support 50.

The shaking prevention mechanism for the drum chair, according to the invention, avoids the possibility that the tightening screw that fixes the seat plate might loosen, which would produce shaking of the chair. That loosening might be caused by movement of the performer on the seat surface, or by the vibrations created by the drum, etc. In addition, a shaking prevention bush is installed at the bottom of the upper support so as to compressively contact the inner peripheral surface of the inner tubular lower support part. This avoids the possibility of shakiness even if the fixtures between the two supports themselves might become loosened.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A chair including a mechanism for preventing shaking of the chair, the chair comprising:

a seat including a seat plate with an underside;

a holder for supporting the seat and located at the underside of the seat plate; an upper support in the form of a first post extending to the holder, the holder being detachably attachable to the upper support, the holder comprising two separate side portions at different positions around the upper support, and a connection between the two sides of the holder operable for drawing the sides of the holder toward each other for clamping the holder around the support for clamping the holder on the upper support;

a lower support beneath the upper support, the lower support including a tube with an interior into which the upper support is installed from above the lower support;

a shaking prevention bush on and around the upper support and within the interior of the lower support, the bush being shaped and sized so as to press against the interior of the tube of the lower support for preventing shaking of the lower support with respect to the upper support; and chair support legs attached to the lower support for supporting the chair.

2. The chair of claim 1, wherein the lower support has an upper end and an opening into the interior of the lower support at the upper end of the lower support;

the upper support having a lower end which passes through the opening of the lower support into the interior of the lower support, the shaking prevention bush being fixed generally at the lower end of the upper support.

3. The chair of claim 1, wherein the holder includes two parts that are opposite to each other, and each holder part having a first portion extending away from the upper support generally in one direction and a second portion extending away from the upper support generally in a different second direction;

the connection between the parts of the holder comprises connections between the respective first portions and between the respective second portions of the holder parts for clamping the holder parts against the upper support.

4. The chair of claim 3, wherein the connections comprise the first portions of the holder parts being at a fixed side and the second portions of the holder parts being at a tightening side of the holder.

5. The chair of claim 4, further comprising a first screw between the first holder parts and comprising a second screw between the second holder parts at the tightening side of the holder, and wherein tightening of the second screw clamps the holder parts against the upper support.

6. The chair of claim 1, wherein the legs are supported on the lower support as to be openable and closable.

7. The chair of claim 1, wherein the bush includes a tapered surface including an end thereof which is slightly larger than the diameter of the interior of the lower support where the bush is disposed within the lower support.

8. The chair of claim 1, further comprising a height setting device on the upper support and engagable with the end of the lower support for establishing the height of the upper support above the lower support and establishing the height of the seat.

9. The chair of claim 8, wherein the upper support is externally threaded and the height setting device is correspondingly and cooperatingly internally threaded to receive the threads of the upper support, such that the rotation of the height setting device with reference to the upper support adjusts the height of the upper support relative to the lower support and sets the height of the chair seat.

10. The chair of claim 1, wherein the chair is a drum chair adaptable for being used by a drum performer.

11. A chair including a mechanism for preventing shaking of the chair, the chair comprising:

a seat including an underside;

a holder for supporting the seat and located at the underside of the seat; an upper support in the form of a first post extending to the holder, the holder being detachably attachable to the upper support;

a lower support beneath the upper support, the lower support including a tube with an interior into which the upper support is installed from above the lower support;

a shaking prevention bush on and around the upper support and within the interior of the lower support, the bush being shaped and sized so as to press against the interior of the tube of the lower support for preventing shaking of the lower support with respect to the upper support; and chair support legs attached to the lower support for supporting the chair.

12. The chair of claim 11, wherein the lower support has an upper end and an opening into the interior of the lower support at the upper end of the lower support;

the upper support having a lower end which passes through the opening of the lower support into the interior of the lower support, the shaking prevention bush being fixed generally at the lower end of the upper support.

13. The chair of claim 11, wherein the holder clamps around the upper support first post.

* * * * *